US006223642B1

(12) United States Patent
O'Dwyer

(10) Patent No.: US 6,223,642 B1
(45) Date of Patent: May 1, 2001

(54) CANNON FOR AXIALLY FED ROUNDS WITH BREECHED ROUND SEALING BREECH CHAMBER

(75) Inventor: James Michael O'Dwyer, Brisbane (AU)

(73) Assignee: Metal Storm Limited, Brisbane (AU)

( * ) Notice: Subject to any disclaimer, the term of this patent is extended or adjusted under 35 U.S.C. 154(b) by 0 days.

(21) Appl. No.: 09/284,310

(22) PCT Filed: Oct. 23, 1997

(86) PCT No.: PCT/AU97/00713

§ 371 Date: Apr. 22, 1999

§ 102(e) Date: Apr. 22, 1999

(87) PCT Pub. No.: WO98/17962

PCT Pub. Date: Apr. 30, 1998

(30) Foreign Application Priority Data

Oct. 23, 1996 (AU) ..... PO 3156

(51) Int. Cl.[7] ..... F41A 3/74
(52) U.S. Cl. ..... 89/7; 89/135; 42/84
(58) Field of Search ..... 42/84; 89/7, 135, 89/137, 26

(56) References Cited

U.S. PATENT DOCUMENTS 2,313,030 * 3/1943 Tauschek ..... 42/84
3,169,333 * 2/1965 Scanlon, Jr. ..... 42/84
5,533,434 * 7/1996 Begneu ..... 89/7

FOREIGN PATENT DOCUMENTS

6194095 * 7/1994 (JP) ..... 89/7

* cited by examiner

*Primary Examiner*—Stephen M. Johnson
(74) *Attorney, Agent, or Firm*—Amster, Rothstein & Ebenstein

(57) ABSTRACT

A projectile firing weapon for firing rounds of the type having a projectile and an associated bore seal which is radially expanded by relative axial displacement between the projectile and the bore seal. The weapon includes a barrel assembly having a barrel bore, a barrel chamber for the round to be fired through the barrel bore, and an associated breech chamber for the next round to be fired. A propellant chamber is formed in the barrel assembly between the barrel chamber and the breech chamber, and a feeder feeds propellant into the propellant chamber. Rounds may be fed axially and sequentially through a loading opening to the barrel assembly and into the breech chamber, thereby forcing the existing round therein into the barrel chamber. Holding means cooperable with the round fed into the breech chamber effect a sealing relationship between the breech chamber and the round therein, causing an operative closure of the barrel chamber. An igniter ignites propellant in the propellant chamber.

12 Claims, 2 Drawing Sheets

CANNON FOR AXIALLY FED ROUNDS WITH BREECHED ROUND SEALING BREECH CHAMBER

BACKGROUND OF THE INVENTION

The invention relates to projectile firing weapons.

This invention has particular, but not exclusive, application to large calibre weapons such as cannons, guns and artillery pieces and the like, but it may also be applied to smaller firearms, such as machine guns, self-propelled artillery and the like.

Tests of prototype versions of firearms utilizing barrels of the type illustrated in my earlier International Patent Application No. PCT/AU96/00459 indicate that such barrel assemblies will perform to expectations. Such tests have indicated a surprising effectiveness of the gas seal between rounds which prevents propellant burn past the seal in the next round to be fired. While the initial tests have been limited to small calibre projectiles the inventor considers that similar results would be achieved in large caliber projectiles, although this is yet to be confirmed.

Typically large calibre weapons and fixed machine guns utilise permanently mounted barrel structures which fire projectiles supported in respective disposable cases which must be removed or ejected at each firing.

It is considered that it would be advantageous to increase the presently available rate of firing of such large rounds as it is during the initial moments of bombardment that most damage can be caused. Thus any increase in the rate of firing such rounds increases the number of rounds which can be delivered onto a target during the initial moments of an attack.

Machine guns and particularly those which utilise fixed barrels, such as machine guns mounted in aircraft, have space and weight limitations which limit the number of rounds which can be carried and the rate of firing due to the need to load the round and unload the spent case at each firing.

This invention aims alleviate at least one of the above-mentioned disadvantages and/or to provide improved projectile firing weapons.

SUMMARY OF THE INVENTION

According to one aspect, this invention resides broadly in a projectile firing weapon for firing rounds of the type having a projectile and an associated bore seal which is radially expanded by relative axial displacement between the projectile and the bore seal, said weapon including:

- a barrel assembly having a barrel bore, a barrel chamber for the round to be fired through the barrel bore and an associated breech chamber for the next round to be fired;
- a propellant chamber formed in the barrel assembly between the barrel chamber and the breech chamber;
- feed means for feeding propellant into the propellant chamber;
- a loading opening to the barrel assembly through which rounds may be fed axially and sequentially into the breech chamber thereby forcing the existing round therein into the barrel chamber;
- holding means cooperable with the round fed into the breech chamber for effecting a sealing relationship between the breech chamber and the round therein causing an operative closure of the barrel chamber, and
- ignition means for igniting propellant in the propellant chamber.

Propellant material may be introduced into the propellant chamber in any desired manner such as in preformed charges associated with either the trailing or leading end of the projectiles. Alternatively preformed charges may be introduced as separate components between projectiles. In a preferred embodiment of the invention the propellant is injected into the propellant chamber either in liquid or powder form.

The round in the breech chamber, hereinafter referred to as 'the breeched round' may be fed laterally by hand or mechanically from a storage magazine in which the rounds are stacked in side by side relationship for feeding into the breech chamber. The round in the barrel chamber is hereinafter referred to as 'the chambered round'.

Preferably the breeched round is advanced axially into the breech chamber wherein the existing round in the breech chamber is forced into the barrel chamber by the introduction of a further round into the breech chamber. For this purpose the barrel chamber and the breech chamber are spaced so as to operatively accommodate end abutting rounds.

For this purpose projectiles may be stored line astern from the barrel assembly or introduced to a line astern position behind the breeched rounds such as by lateral feeding as described above. Suitably the breech chamber is a plain continuation of the barrel chamber. The barrel bore may be plain or rifled.

Preferably each round is formed with a bore seal thereon which engages in sealing contact with the breech chamber when the trailing round is held by the holding means. The bore seal suitably operatively disengages the breech chamber when the breeched round is advanced to the barrel chamber. If desired the bore seal may be in the form of a sabot assembly which is discarded after discharge from the barrel.

In a preferred form the bore seal is in the form of a collar which encircles a trailing portion of the projectile and is formed with a part conical inner face which engages with a complementary outer face of the projectile such that axial movement of the collar relative to the projectile is accompanied by an outward expansion of the collar into sealing engagement of the breech chamber. This expansion may be induced in any suitable manner such as by forced rearward movement of the projectile or by forward movement of the collar independent of the projectile.

Suitably the holding means operates only to advance the rounds or components thereof towards the barrel chamber. Alternatively the holding means may cause a partial retraction of the round or a component thereof in the breech chamber to effect or break the round seal therewith.

In a preferred embodiment advancement of the holding means is provided by actuation of the holding means which suitably serves only to hold the collar in its sealing relationship with the breech chamber, the projectile being otherwise restrained against forward movement by being in contact with the leading projectile or by engaging stop means or the like in the breech chamber or by locating at the end of a stroke of the loading means which forces the rounds sequentially into the barrel breech.

Preferably the breeched round is restrained against rearward movement by the wedging action between the bore seal and the projectile. However if desired the holding means may act against the collar and projectile to resist rearward movement of the breeched round during firing.

The holding means is suitably retractable, such as by being segmented and outwardly retracted, so that after the firing of a projectile the holding means may be retracted so as not to impede the progress of a further round into the breech chamber. The holding means is also suitably axially moveable so that after a round has been loaded into the breech chamber the holding means may be advanced towards the projectile so as to urge the sealing collar forwardly along the projectile and thus into sealing engagement with the breech chamber.

It is also preferred that the propellant chamber is formed as a rearwardly divergent annular chamber separating the barrel chamber and the breech chamber which is suitably formed as a continuation of the barrel chamber.

In another aspect this invention resides in a projectile firing weapon as variously defined above and including a round in the barrel chamber and an abutting round in the breech chamber arranged with its bore seal urged outwardly into engagement with the breech chamber, and wherein the bore seal on the breeched round is operatively disengaged from sealing contact with the breech chamber when the breeched round is advanced towards the barrel chamber.

Preferably the breeched round is advanced by urging the projectile forward causing initial partial disengagement with the bore seal so as to permit it to disengage from the breech bore.

The propellant chamber may be a cylindrical chamber formed as a rearward extension of the barrel beyond the chambered round and about the nose of the breeched round but preferably the propellant chamber is in the form of a recess in the barrel wall located rearwardly of the chambered round. The propellant chamber may be of plain cylindrical form or of part-hemispherical or toroidal form or the like or it may diverge rearwardly so as to direct propellant expansion in a direction towards the chambered round.

In a further aspect this invention resides broadly in a method of closing a barrel of a projectile firing weapon against propellant reaction during firing, the method including introducing a further round into the barrel behind the round to be fired and the propellant chamber;

effecting a seal between the further round and the barrel, and holding the sealed further round in the barrel during firing. Suitably the projectile firing weapon is as defined variously above.

The further round may be held in the barrel by retaining means structured to resist the reactive forces imposed upon firing the active round but preferably the sealing between the passive round and the barrel utilises a wedge type action between a sealing ring and its mounting on the passive round which is held in the barrel by retaining means which effects the wedge type sealing action.

In yet a further aspect this invention resides broadly in a projectile firing weapon including:a a barrel assembly having a barrel bore, a barrel chamber for the round to be fired through the barrel bore and an associated breech chamber for the next round to be fired;

a propellant chamber formed in the barrel assembly between the barrel chamber and the breech chamber;

feed means for feeding propellant into the propellant chamber;

loading means for axially and sequentially loading rounds into sealed engagement with the breech chamber, and ignition means for igniting propellant in the propellant chamber.

BRIEF DESCRIPTION OF THE DRAWING

In order that this invention may be more readily understood and put into practical effect, reference will now be made to the accompanying drawings which illustrate a preferred embodiment of the invention, and wherein.

DETAILED DESCRIPTION OF THE PREFERRED EMBODIMENTS

Figure 1:
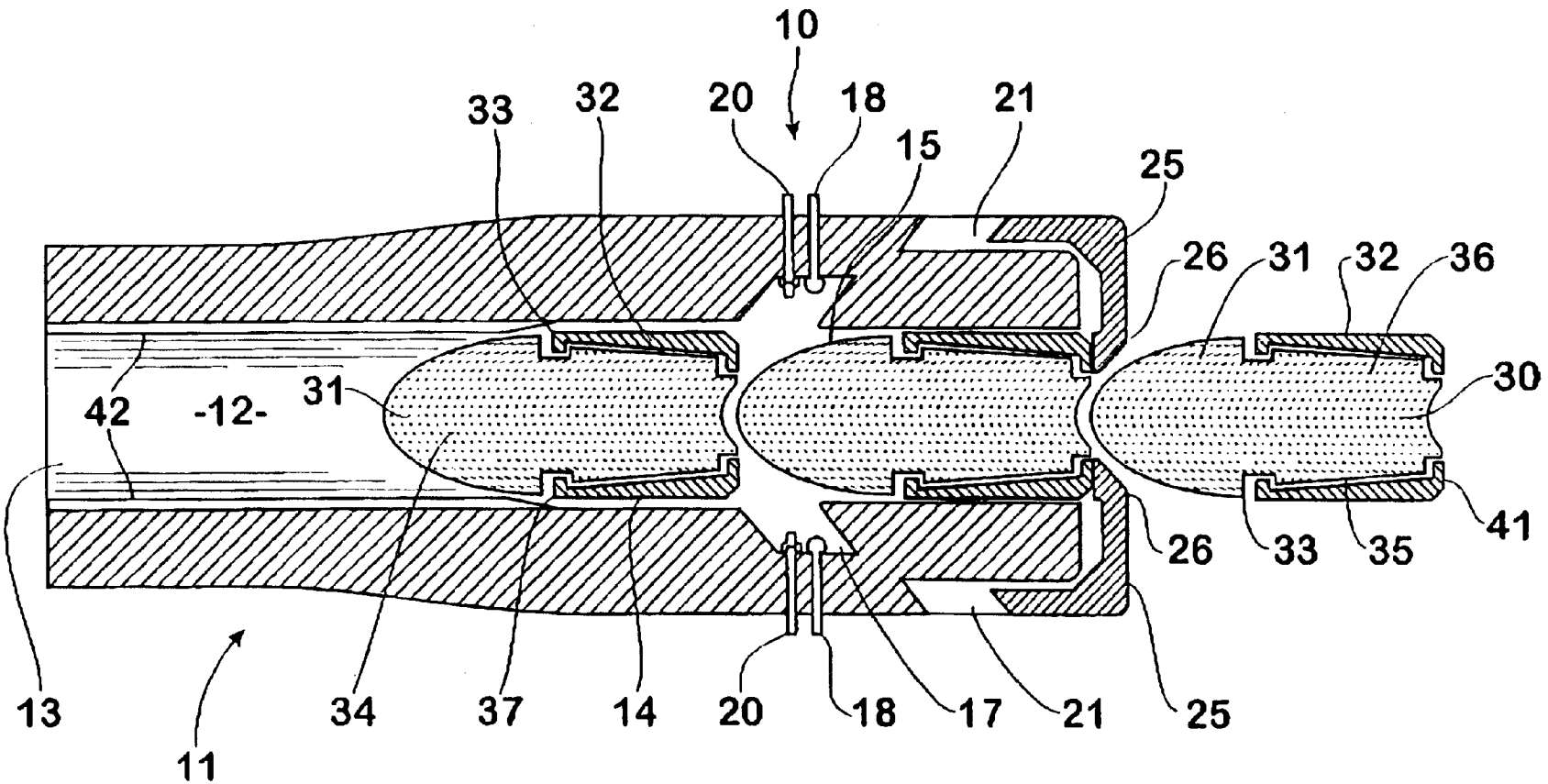
FIG. 1 is a diagrammatic cross-section of a cannon.

A large calibre cannon 10 or the like weapon comprises a barrel assembly 11 formed with a straight through bore 12, the leading portion of which forms the rifled bore 13 while its trailing portion forms the barrel chamber 14 and breech chamber 15. The barrel chamber 14 is separated from the breech chamber 15 by a propellant chamber 17 extending peripherally about the bore 12 and diverging rearwardly therefrom. The propellant chamber 17 is provided with liquid propellant injectors 18 and ignition means 20.

The trailing end of the barrel assembly 11 is thickened to accommodate the propellant chamber 17 as well as external guide slots 21 for the segmented holding means 25 which is able to be moved axially along the guide slots 21 as well as radially so that its inner part-annular extensions 26 may be cleared from the line of the bore 12 to permit a round 30 to enter the bore 12 into the breech chamber 15.

Each round 30 comprises a projectile 31 and a trailing annular bore seal 32. The leading end of the annular bore seal 32 has an inwardly directed collar 33 which locates slidably in an annular recess 37 formed at the base of the head 34 of the projectile 31.

The inside surface 35 of the annular bore seal 32 and the outer surface of the tail 36 of the projectile 31 are formed as complementary frusto-conical surfaces such that forward movement of the annular bore seal 32 relative to the projectile 31 results in outward expansion of the annular bore seal 32.

This expansion, when the round is located in the breech chamber, will result in a sealing engagement with the bore 12. This seal is maintained by a suitable locking mechanism, generally indicated at 44 which forces the holding means 25 forwardly urging its fingers 26 against the flanged rear end 41 of the bore seal 32 and causing the necessary axial movement of the seal 32 to effect an operative seal with the breech chamber wall.

The breeched round 30 is restrained from advancing through the bore 12 by abutment of its projectile with the tail of the chambered projectile which is restrained in position by inwardly projecting rifling lands 42 ahead of the barrel chamber 14.

Figure 2:
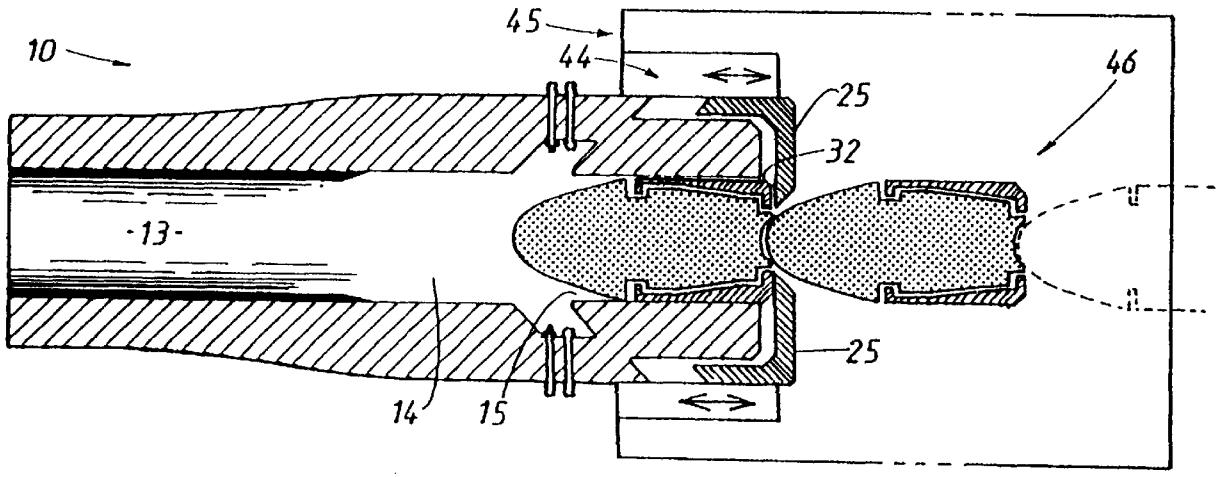
FIG. 2 illustrates the embodiment of FIG. 1 with the chambered round fired.
Figure 3:
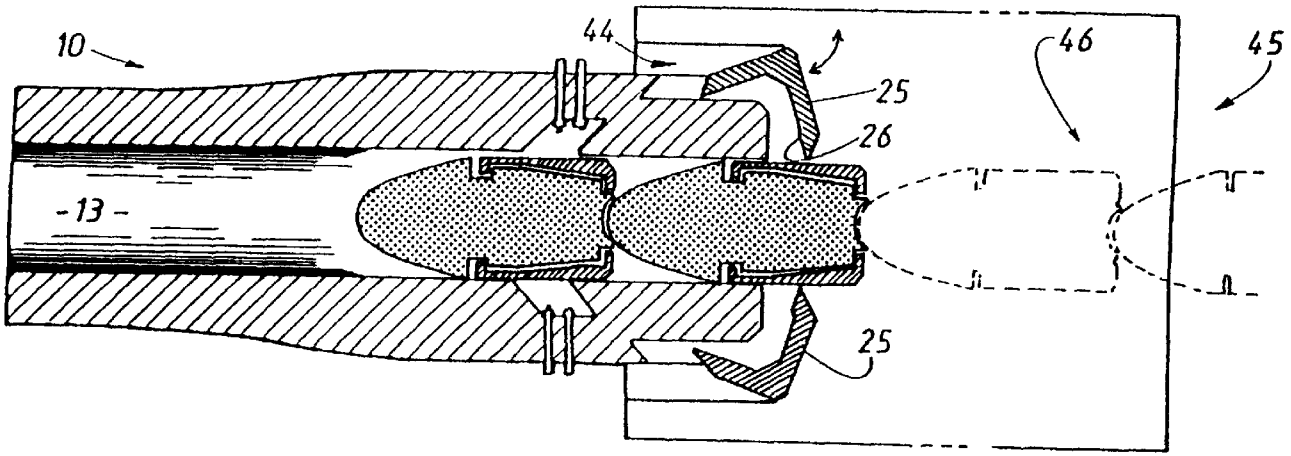
FIG. 3 illustrates the loading of the next round to be fired.

In use the rounds 30 are stored line-astern in a magazine and a loading mechanism, not shown, but indicated generally at 45 in FIGS. 2 and 3 and arranged to push against the magazine rounds 46 or some of them to force the two leading rounds into the barrel assembly 11 until the leading round 30 abuts the lands 42 whereby it is located in the barrel chamber 14. The chambered round is then located in the barrel 14 in front of the propellant chamber 17 and the trailing round is located in the breech chamber 15 as illustrated in FIG. 1.

The locking mechanism 44 is then actuated to pivot the fingers 25 inwardly to locate behind the rear flanged end 41 of the bore seal 32, and then advanced axially to force the bore seal 32 forwardly marginally along the frusto-conical tail portion of the projectile 31. This action jams the bore seal 32 between the projectile and the bore 12 and forms a sealed breech chamber 15. This action is possible as the engagement of the leading end of the chambered round with the rifling lands 42 prevents forward movement of the breeched round during expansion of the bore seal 32.

Liquid propellant is then injected into the propellant chamber 17 through the propellant injectors 18 and ignited by the ignition means 20. The expanding gases fire the active round whereafter the sequence may be repeated in rapid succession if desired such as in the order of 20 to 30 rounds per minute for a short period if required.

After the leading round has been fired, the column of rounds is advanced, advancing the next round to a barrel chamber 14 and a following round into the breech chamber 15. During this action, the initial forward movement of the projectile 31 in the breech chamber is axial movement relative to the bore seal 32, dislodging the bore seal 32 from its sealed engagement with the breech chamber.

The bore seal 32 then advances with the projectile when its inwardly directed peripheral flange 33 abuts the trailing face of the annular recess 37. It is thus carried with the projectile into the barrel chamber 14. In this position the expanded collar assists in forming an efficient gas seal for propulsion of the round from the barrel. Further, during firing, and rearward movement of the projectile 31 will assist in the outward sealing force applied by the bore seal 32 to the breech chamber. Suitably the projectile and the bore seal are formed of steel or a suitably alloy.

In an alternate embodiment the bore seals 32 are formed as sabot extending outwardly beyond the projectiles 31 and adapted to fall away after exiting the barrel. In yet a further embodiment the breech chamber is formed to an interference fit with a one piece projectile which is forced into position by a suitable loading mechanism and expanded elastically of plastically by combustion of the propellant to effect the sealing of the barrel chamber.

The rounds could be solid rounds, high explosive rounds or launching rounds. An additional advantage provided by the cannon 10 is that after each firing the burnt gases and the like are not exhausted rearwardly to the position of the operator as the breech opening is at all times closed by a breeched or partially breeched round.

It will of course be realised that the above has been given by way of illustrative example only of the invention and that all such modifications and variations thereto as would be apparent to persons skilled in the art are deemed to fall within the broad scope and ambit of this invention as claimed in the appended claims.

What is claimed is:

1. A projectile firing weapon for firing rounds having a projectile and an associated bore seal which is radially expanded by relative axial displacement between the projectile and the bore seal, said weapon including:

a barrel assembly having a barrel bore, a barrel chamber for the round to be fired through the barrel bore and an associated breech chamber for the next round to be fired;

a propellant chamber formed in the barrel assembly between the barrel chamber and the breech chamber;

feed means for feeding propellant into the propellant chamber;

a loading opening to the barrel assembly through which rounds may be fed axially and sequentially into the breech chamber thereby forcing the existing round therein into the barrel chamber;

holding means cooperable with the round fed into the breech chamber for effecting a sealing relationship between the breech chamber and the round therein causing an operative closure of the barrel chamber, and ignition means for igniting propellant in the propellant chamber.

2. A projectile firing weapon as claimed in claim 1, wherein the propellant is fed into the propellant chamber in liquid form.

3. A projectile firing weapon as claimed in claim 2, wherein the propellant chamber is formed as a rearwardly divergent annular chamber separating the barrel chamber and the breech chamber.

4. A projectile firing weapon as claimed in claim 1, wherein the breech chamber is formed as a continuation of the barrel chamber.

5. A projectile firing weapon as claimed in claim 4, wherein the barrel chamber and the breech chamber are spaced so as to operatively accommodate end abutting rounds.

6. A projectile firing weapon as claimed in claim 1 and a round in the barrel chamber, the chambered round, and an abutting round in the breech chamber, the breeched round, and wherein the bore seal on the breeched round is operatively disengaged from sealing contact with the breech chamber when the breeched round is advanced towards the barrel chamber.

7. A projectile firing weapon as claimed in claim 1 and a round, wherein each round includes as the end seal the projectile, the projectile having a rearwardly converging trailing portion and the associated bore seal supported by the trailing portion, the bore seal having a complementary annular design and being expanded radially by advancement over the trailing portion, the trailing portion terminating in an abutment for the nose of a following round.

8. A projectile firing weapon as claimed in claim 7 and a round, wherein said holding means cooperates with the trailing end of said bore seal and forces it forwardly after each round has been fed into the barrel breech.

9. A projectile firing weapon as claimed in claim 8 and a round, wherein said holding means is retracted radially after firing of the chambered projectile so as not to impede the introduction of a further said round into the breech chamber.

10. A projectile firing weapon as claimed in claim 6, wherein the bore seal is in the form of a sabot which is discarded from the projectile after discharge from the barrel.

11. A projectile firing weapon as claimed in claim 7, wherein the bore seal is in the form of a collar which encircles a trailing portion of the projectile and is formed with a part conical inner face which engages with a complementary rearwardly tapered trailing face of the projectile.

12. A projectile firing weapon as claimed in claim 7, wherein the projectile has a broad annular recess extending medially thereabout and said bore seal has an inwardly directed collar which extends into said recess and limits the relative axial movement between the bore seal and the projectile.

* * * * *